US006474504B1

(12) United States Patent
Simmons et al.

(10) Patent No.: US 6,474,504 B1
(45) Date of Patent: Nov. 5, 2002

(54) FLOW REGULATION VALVE FOR A BEVERAGE DISPENSER

(75) Inventors: Philip Andrew Simmons, Alcester (GB); Martin Stanley Johnson, Bishops Itchington (GB)

(73) Assignee: IMI Cornelius Inc., Anoka, MN (US)

( * ) Notice: Subject to any disclaimer, the term of this patent is extended or adjusted under 35 U.S.C. 154(b) by 0 days.

(21) Appl. No.: 09/937,369

(22) PCT Filed: Mar. 17, 2000

(86) PCT No.: PCT/GB00/01038

§ 371 (c)(1),
(2), (4) Date: Sep. 21, 2001

(87) PCT Pub. No.: WO00/56656

PCT Pub. Date: Sep. 28, 2000

(30) Foreign Application Priority Data

Mar. 23, 1999 (GB) ..... 9906627
May 19, 1999 (GB) ..... 9911642

(51) Int. Cl.[7] ..... B67D 5/16

(52) U.S. Cl. ..... 222/59; 222/63; 222/129.1; 222/504

(58) Field of Search ..... 222/59, 63, 71, 222/129.1, 504

(56) References Cited

U.S. PATENT DOCUMENTS 2,517,083 A * 8/1950 Carlson ..... 138/46
4,708,263 A * 11/1987 Le Granse ..... 222/504
4,886,190 A * 12/1989 Kirschner et al. ..... 222/57
5,065,910 A * 11/1991 Fiedler ..... 222/504
5,731,981 A * 3/1998 Simard ..... 222/59
5,934,507 A * 8/1999 Motosugi ..... 222/63

* cited by examiner

*Primary Examiner*—Joseph A. Kaufman
(74) *Attorney, Agent, or Firm*—Sten Erik Hakanson

(57) ABSTRACT

The present invention is a flow rate control valve through which a liquid flows and from which the liquid is dispensed. The flow rate of the liquid is sensed and that information is sent to a microprocessor based control. The control operates a drive of the control valve so as to vary the resultant rate at which the liquid is dispensed therefrom. The drive operates a piston closure member that extends closely within a cylindrical passageway. The passageway has an inlet end and an outlet end and the drive operates the closure member in the passageway to a plurality of positions from a first position at the inlet end and a second position at the outlet end. The wall of the passageway defines at least one groove having a transverse cross-section that increases in area in a downstream direction from the passageway inlet to the passageway outlet or in an upstream direction from the passageway outlet to the passageway inlet, whereby movement of the closure between the first position and the second position varies the flow rate of the liquid through the control valve as a function of the cross-sectional area of the groove.

1 Claim, 3 Drawing Sheets

FLOW REGULATION VALVE FOR A BEVERAGE DISPENSER

BACKGROUND OF THE INVENTION

This invention relates to the dispensing of beverages. It is particularly concerned to provide a means of dispensing carbonated beverages and, although not intended to be limited thereto, it will be more specifically described below with particular reference to carbonated beverages.

Carbonated beverages, which for the purpose of this application include carbonated water and carbonated flavoured drinks, e.g. colas and other carbonated mixtures of water and syrup, are required to have and to maintain a particular amount of carbonation in order to possess the desired qualities of flavour and texture in the drink. Thus, although the desired amount of carbonation may vary from beverage to beverage and may vary within relatively restricted limits for any particular beverage, it is important that these limits are not breached if the consumer is to receive a satisfactory product.

It will also be appreciated that the level of carbonation can be affected by the manner of dispense of the beverage. Carbon dioxide "break out" during dispense into, say a glass, causes frothing of the liquid and excessive frothing can lead to undue loss of carbonation and a less satisfactory product in the glass.

It is, therefore, an object of the invention to provide a means of dispensing a liquid which when applied to a carbonated liquid will reduce carbon dioxide break out.

Accordingly, the invention provides an apparatus to dispense a beverage, the apparatus comprising a valve through which the beverage is to be dispensed, actuation means to open and close the valve, means to propel the beverage from a source thereof through the open valve to a dispense point, flow rate determining means to monitor the rate of flow through the valve and pre-programmed control means responsive to the flow rate data provided to it by the flow rate determining means, the control means causing the actuation means to vary the opening of the valve to provide a predetermined variable rate of dispense, wherein the valve comprises a housing containing a passageway between an inlet and an outlet of the valve, a closure member movable in the passageway from a first position in which the valve is fully closed to a second position in which the valve is fully open, the closure member engaging the wall of the passageway to seal the passageway, the wall of the passageway or the closure member defining at least one groove, the groove having a transverse cross-section that increases in area in the downstream or upstream direction, whereby movement of the closure member from the first position towards the second position opens a flow channel through the groove.

The apparatus may also include a dispense tap through which the beverage can be dispensed into a suitable receptacle, e.g. a cup or glass.

The flow rate determining means may be any suitable means and may determine the flow rate by direct measurement or by calculation from a measured property. Thus, for example, the means may be, a turbine or a magnetic or ultrasonic or infra-red flow detector.

The control means will preferably be an electronic control means, e.g. a microprocessor, which is pre-programmed to provide, via the flow rate determining means and the valve actuation means, a dispense rate following a predetermined profile or flow curve. Thus the electronic control means can be programmed to provide specific varying flow rates for different beverages depending, for example, on their desired degree of carbonation and/or for different cup or glass sizes into which the beverage is to be dispensed.

The valve groove(s) may be, for example, of tapering V-shape and will, for convenience, hereafter be referred to as "V-grooves" and the valves of this general type as "V-groove valves", although it will be appreciated that the grooves may, if desired, have a different tapering cross-section, e.g. of circular, rectangular or other shape. The progressive increase or decrease in area of the groove flow channels can produce excellent linear flow through these V-groove valves. Moreover, V-groove valves have been found to be surprisingly effective in reducing the degree of carbon dioxide break out that can occur when a carbonated beverage is dispensed through a valve.

The valve closure member preferably comprises a substantially rigid piston, which may be of the same material as the housing, the latter preferably also being substantially rigid. They may be made of, for example, metal, plastics material or ceramic material. Suitable rigid plastics materials include, for example, acetals, and acrylonitrile-butadiene-styrene. The groove(s) may be, for example, cut or moulded into the material of the passageway wall or closure member by conventional means depending on the material used.

Preferably the grooves are formed in the passageway wall.

The closure member may carry one or more sealing rings to engage the wall of the passageway in the first position, i.e. the closure member may engage the wall of the passageway by means of the sealing ring(s) to close the outlet. Alternatively, sealing rings for this purpose may be located in the wall of the passageway. In a yet further embodiment the closure member and passageway may be a precision fit in the first position to close the outlet without a seal.

The valve passageway preferably comprises at least a portion in the form of a right cylinder with the closure member comprising a corresponding cylinder of outside diameter slightly less than the internal diameter of the passageway and, typically, the closure member having an O-ring seal attachment around its outer surface to seal against the passageway wall.

The actuation means to open and close the valve preferably comprises drive means for a piston or closure member, movement of the closure member to and fro in the passageway between the inlet and outlet of the valve determining the degree of opening. The drive means may be, for example, a lever mechanism, a stepper motor, e.g. of the pulsed magnetically-driven type, a proportional solenoid actuator; a diaphragm operated mechanism or the like.

The means to propel the beverage from its source through the valve to the dispense point may be any convenient means. For example, as are conventionally used, the means may be a pump or a source of pressurised gas.

Thus the invention provides a means of providing a dispense flow rate profile particularly suited to the particular circumstances of the beverage to be dispensed. A different flow rate v. time profile may be desirable for any particular beverage when dispensed into a small glass compared with dispense into a large glass and the control means can readily be programmed to provide the optimum profile for each circumstance. A slower dispense rate for smaller glasses will reduce splashing whereas a faster speed for large glasses will reduce filling time.

The flow rate profile may also be pre-programmed to avoid excessively abrupt flow changes at the beginning and end of a dispense. Thus, for example, a "soft" start and finish to the dispense may be programmed into the control means. In other words, instead of the dispense valve being rapidly moved from the fully closed to the fully open position on commencement and at the end of dispense, it can be gradually opened from fully closed to a partially open position and then moved rapidly to the fully open position and then towards the end of the dispense it can be moved rapidly from fully open to a partially open position and then be closed gradually from that partially open position.

By way of illustrative example only, for a dispense of ten seconds, the flow rate could be controlled to increase from zero to, say, 20 ml/sec over a two second period and then rapidly increased to a maximum flow rate of, say 160 ml/sec over a short period of time of about two further seconds, maintained at that maximum rate for about four seconds, then rapidly reduced to 20 ml/sec over a one second period and then reduced to zero over the final second. V-groove valves as used in the present invention are particularly amenable to such controlled opening and closing and, as indicated above, this is particularly advantageous when dispensing carbonated beverages.

The control means effectively monitors the flow rate and time and so can calculate the volume dispensed so far at any instant, the remaining volume to be dispensed, e.g. for a ½ liter total dispense, and hence the flow rate(s) then required to achieve the desired total dispense volume and time.

The dispense point, e.g. dispense tap, may incorporate a plurality of options, e.g. with a separate push button dispense operation for each option, whereby triggering of a particular option alerts the control means to activate the chosen dispense routine. Alternatively, a number of dispense taps, each for one or more specific dispense routines, may each be connected to a single control means.

BRIEF DESCRIPTION OF THE DRAWINGS

Embodiments of the invention will now be described by way of example only with reference to the accompanying drawings in which.

DETAILED DESCRIPTION OF THE INVENTION

Figure 1:
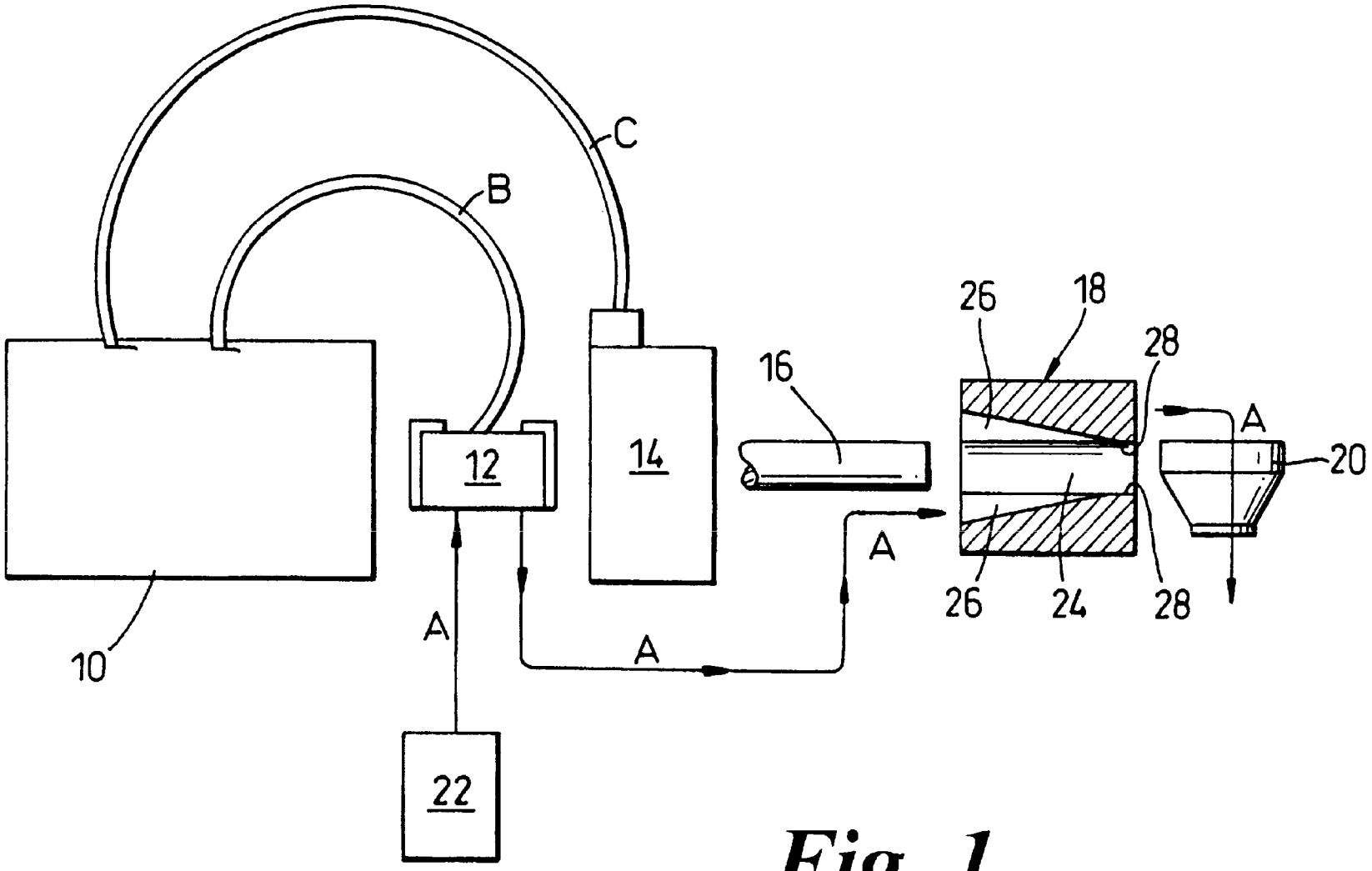
FIG. 1 is a schematic arrangement of one embodiment of the invention.

In FIG. 1 the apparatus comprises a control means in the form of an electronic logic board 10, a flow rate determining means 12, an actuator 14, to move a piston 16, a V-groove valve 18 and a mixing nozzle 20.

Flow rate determining means 12, which may, as indicated above, be a turbine or a magnetic ultrasonic or infra-red flow detector, determines the rate of flow of liquid flowing through line A at any point in time from a source 22 of the liquid. The sensor 12 is electrically connected via line B to control board 10, which has been preprogrammed to apply a predetermined flow rate for each type of dispense to be provided through the apparatus. Board 10 controls actuator 14, which may be, for example, a stepper motor, via electrical connection C. Actuator 14, according to the instructions it receives from control board 10 moves piston 16 to the right or left into and out of valve 18.

Valve 18 has a central through passageway 24 and a pair of opposed V-grooves 26 across the passageway, the cross-section of the grooves narrowing in the direction of flow (line A). When piston 16 is in its fully extended position to the right, it mates with internal walls 28 of the valve passageway beyond the narrow end of the V-grooves and hence closes the valve. As the piston is moved to the left the valve opens and the through flow increases the further the piston is moved to the left, until the fully open position, as illustrated, is reached. (A V-groove valve arrangement is described in more detail below with reference to FIG. 2).

Liquid flowing through the valve passes into mixing head 20 from which it can be dispensed. The dispense point may be electrically operated (in a conventional manner not shown) to operate a pump or other means to propel the liquid from the source and to initiate opening of the valve.

Figure 2:
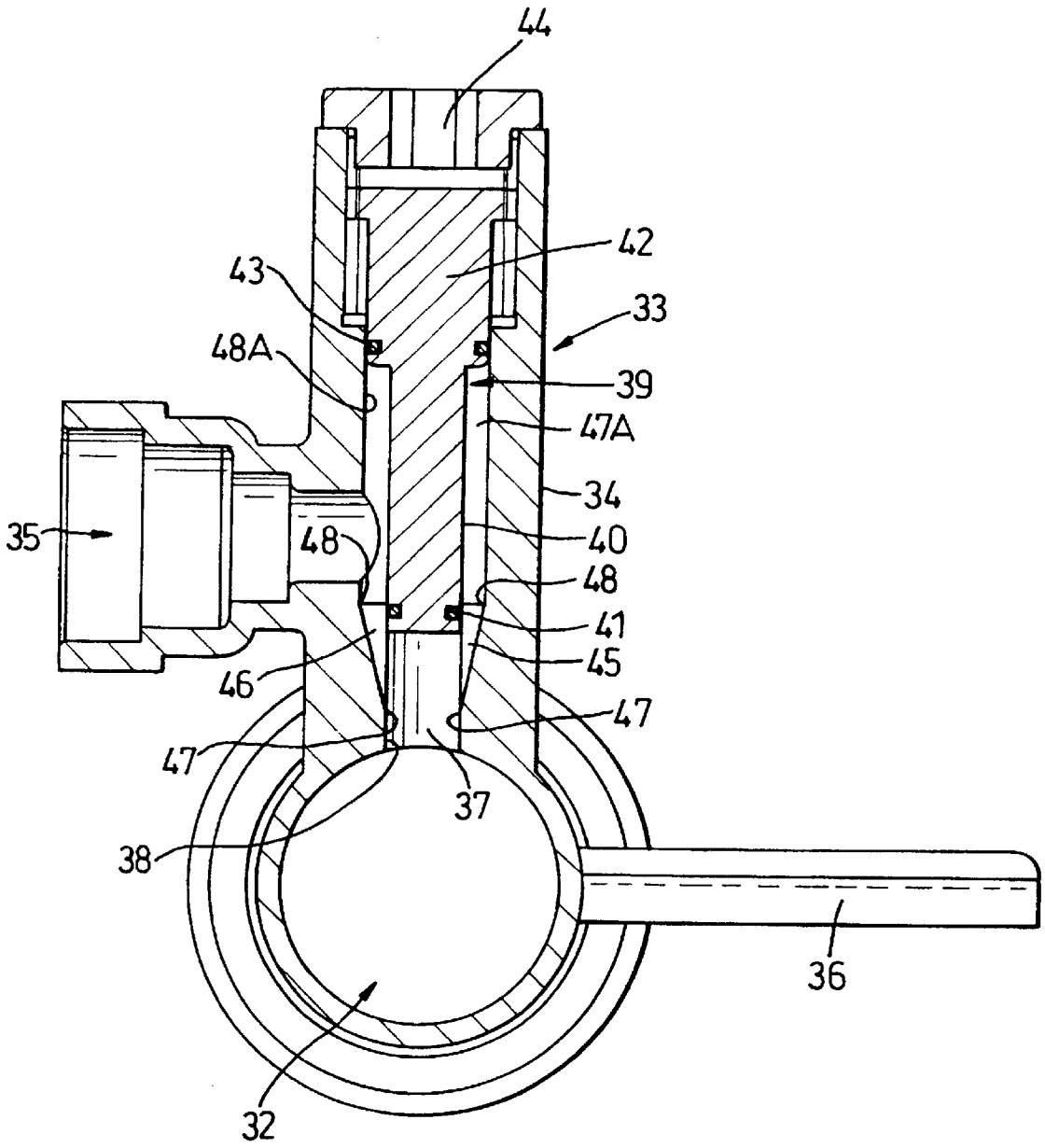
FIG. 2 is a sectional view of one form of valve usable in the invention.

As shown in FIG. 2, outlet 35 of valve 30 is connected to a manifold passageway 32 by valve passageway 37. Passageway 37 is of right cylindrical shape and is defined by the lower, cylindrical wall 38 of housing 34. (Manifold passageway 32 may be connected to a flow line such as line A from sensor 12 in FIG. 1. Outlet 35 may be connected to a mixing head such as 20 in FIG. 1.).

Housing 34 contains a valve closure member 39 having a cylindrical stem portion 40 carrying towards its inlet (lower) end an 0-ring 41. Stem portion 40 is of external diameter relative to the diameter of valve passageway 37 such that its O-ring 41 seals against wall 38.

Stem portion 40 continues into a stepped portion 42 of the closure member 39 which is of larger diameter than stem portion 40 and seals by means of an O-ring 43 against the housing wall 48A at an upper, wider cylindrical chamber 37A into which passageway 37 leads. Stepped portion 42 of closure member 39 is connected at its end remote from stem portion 40 to connection means 44 by means of which the closure member 19 may be connected to an actuator (such as 14 in FIG. 1) so as to be set to the desired position, i.e. raised and lowered to fully close, partially open or fully open a flow channel through valve passageway 37.

The valve may be secured in a desired position by a lug 36.

The valve is shown in the almost fully open position in FIG. 2. A pair of opposed grooves 45, 46 is formed in the housing wall 38. Each groove extends from a point 47 on wall 38 which is downstream of the position at which O-ring 41 contacts wall 38 in the fully closed position of the valve, to a point 48 where the wider chamber 37A commences and which represents the fully open position of the valve.

The grooves 45, 46 are of tapering cross-section and, in this embodiment, increase in cross-sectional area in the downstream direction. The grooves are of generally "V" cross-section, and, for example, the base of each V-shaped groove may extend outwardly, i.e. deepen the groove, in the downstream direction. The arms of the "V" may also open outwardly, i.e. the angle of the "V" may increase, along the groove in the same direction.

Figure 3:
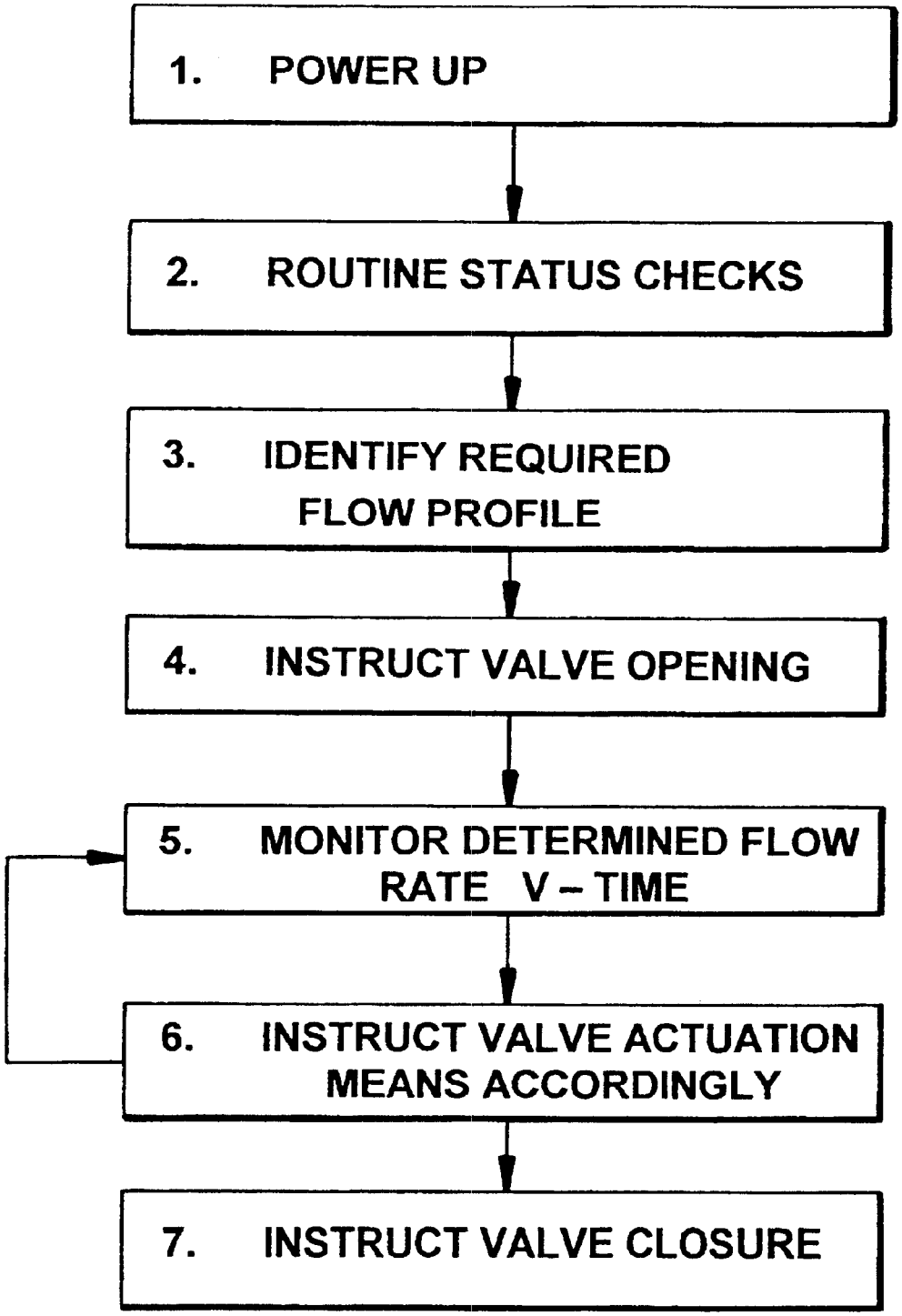
FIG. 3 is a block diagram showing an operational sequence performed by a control means used in the invention.

FIG. 3 shows a sequence of steps performed by a control means such as logic board 10 of FIG. 1. As indicated, following switching on power at step 1, the control means is programmed at step 2 to carry out a sequence of status checks to ensure that there is no problem with the system. The skilled man of the art will be familiar with such an arrangement. Step 3 is actioned when a particular dispense option has been selected and the control means identifies the specific flow profile required therefor. This is followed by the valve being opened to the appropriate initial degree for that flow profile—step 4. The flow rate through the valve is then monitored—step 5—against time and this is compared with the required flow profile. Any required changes to the valve opening to maintain the flowing of the required profile are conveyed via the valve actuator—step 6—and this sequence of step 5 monitoring and step 6 changes where required is continued until the desired dispense is completed whereupon the control means instructs and effects closure of the valve—step 7.

What is claimed is:

1. A control valve for dispensing a fluid there from at a desired flow rate, the control valve comprising:

a valve body defining therein a flow passageway having an inlet end and an outlet fluid dispensing end and the passageway inlet end connectable to a pressurized source of the fluid, electrically operated drive means connected to a piston closure member extending closely within the passageway, and the piston closure member operable by the drive means to move a distal end thereof to a plurality of positions along the passageway between and including a full flow position and a stop flow position, and the passageway having one or more grooves formed therein, each of the one or more grooves extending from the passageway full flow position to the passageway stop flow position and the one or more grooves each varying in cross-sectional area along the length thereof so that flow of fluid through the passageway is regulated as a function of the total cross-sectional area of the one or more grooves through which the liquid can flow as is determined by the position of the piston closure member distal end within the passageway, flow sensing means for sensing the flow rate of the liquid through the control valve, and control means for receiving inputs from the flow rate sensing means and connected to the drive means for setting the position of the distal end of the piston closure member for controlling the flow rate of the liquid from the passageway outlet end.

* * * * *